US005292111A

United States Patent [19]

Hansch

[11] Patent Number: 5,292,111

[45] Date of Patent: Mar. 8, 1994

[54] METHOD AND APPARATUS FOR OPENING FOLDED PRINTED PRODUCTS HAVING DISTINCT SHEET OPENING AND HOLD-OPEN MEANS

[75] Inventor: Egon Hansch, Wetzikon, Switzerland

[73] Assignee: Ferag AG, Hinwil, Switzerland

[21] Appl. No.: 895,334

[22] Filed: Jun. 8, 1992

[30] Foreign Application Priority Data

Jun. 10, 1991 [CH] Switzerland ..... 01724/91

[51] Int. Cl.[5] ..... B65H 39/02; B65H 29/04

[52] U.S. Cl. ..... 270/54; 271/247; 271/204

[58] Field of Search ..... 270/54, 55, 57; 271/246, 247, 277, 204, 206; 198/474.1, 477.1, 802, 803.1

[56] References Cited

U.S. PATENT DOCUMENTS

| | | | |
|---|---|---|---|
| 3,623,386 | 11/1971 | Bach et al. . | |
| 4,201,286 | 5/1980 | Meier . | |
| 4,489,930 | 12/1984 | Meier | 270/55 |
| 4,555,101 | 11/1985 | Stobb | 271/277 |
| 4,605,213 | 8/1986 | Hechler . | |
| 4,684,116 | 8/1987 | Hansch . | |
| 4,684,117 | 8/1987 | Honegger et al. . | |
| 4,709,910 | 12/1987 | Honegger . | |
| 4,729,554 | 3/1988 | Honegger | 270/55 |
| 5,052,667 | 10/1991 | Hansch . | |
| 5,169,139 | 12/1992 | Stauber et al. | 271/204 |

FOREIGN PATENT DOCUMENTS

| | | | |
|---|---|---|---|
| 10169490 | 1/1986 | European Pat. Off. . | |
| 379879 | 8/1990 | European Pat. Off. . | |
| 1945501 | 3/1970 | Fed. Rep. of Germany | 270/55 |
| 618398 | 7/1980 | Switzerland . | |
| 667859 | 11/1988 | Switzerland . | |

*Primary Examiner*—Richard A. Bertsch
*Assistant Examiner*—John Ryznic
*Attorney, Agent, or Firm*—Willian Brinks Olds Hofer Gilson & Lione

[57] ABSTRACT

A conveying device having individually controllable grippers conveys the printed products in the conveying direction to a straightening station where the printed products are aligned. Subsequently, for opening, the folded printed products are fed to an opening device with their open edge leading and are then conveyed further to a transfer region, which is spaced apart from the opening device, for depositing on the rests. The separation of the different functions, i.e. the alignment, the opening and the depositing of the printed products allows simple setting to different formats of the printed products to be processed. Between the opening device and the transfer region, the open printed products are held open by a holding-open device.

23 Claims, 7 Drawing Sheets

METHOD AND APPARATUS FOR OPENING FOLDED PRINTED PRODUCTS HAVING DISTINCT SHEET OPENING AND HOLD-OPEN MEANS

BACKGROUND OF THE INVENTION

This invention is related to U.S. patent application Ser. No. 07/895,081, entitled "Method And Apparatus For Processing Printed Products", filed concurrently herewith.

The present invention relates to a method and an apparatus for opening folded printed products and depositing them on a saddle-type rest and more particularly to a method and apparatus for opening folded printed products and depositing them on saddle-type rests wherein the products are conveyed by individually controllable grippers of a conveying device.

An apparatus of this type is described, for example, in Swiss Patent Specification 667,859. In the disclosed arrangement, each of the printed products are held securely against rotation in the central region of the fold by a gripper of a conveying device. The printed products are also compressed by means of a pusher element which acts on an end region of the fold. An opening strip is introduced between the halves of the printed products starting from the compressed fold. The opening strip is moved along the relevant side edge of the printed products to the region of the open edge opposite the fold to separate the two halves from one another. In order to hold the printed products securely against rotation, the grippers have two clamping fingers which are each controllable independently of one another and a clamping jaw which interacts with both clamping fingers. In order to further open the printed products which have previously been opened by means of the pusher element and the opening strip, the clamping finger closer to the pusher is moved into its open position. The relevant printed product is then rotated about the clamping point between the other gripper and the clamping due to the effect of the pusher element. The rotation thus causes printed product to be positioned obliquely. One half of the printed product is then introduced into an opening cam of an opening device in the region of the corner of the printed product which is now leading due to the oblique positioning. The opening cams are rotationally or circularly driven around a wheel which is rotatable about an axle and which runs perpendicular to the conveying direction of the printed products. By deflecting the opening cam around the wheel, the half of the printed product held by the relevant opening cam is separated from the other half starting at the open edge. During this separation, a saddle-type rest of a drum-type collecting device is introduced from below between the two halves of the printed product. After the relevant opening cam has opened, the two halves of the printed product grip around the saddle-type rest from above. The relevant gripper of the conveying device is then opened causing the printed product to drop astride this rest. The opening device of this arrangement is thus located in the transfer region of the printed products to the rests and is actively involved in the transfer.

Similar devices, in which the printed products, however, are not placed obliquely for introduction into the opening cams of the opening device, are disclosed in EP-A-0,341,425 or the corresponding U.S. Pat. No. 5,052,667, EP-A-0,208,081 or the corresponding U.S. Pat. No. 4,684,117 or DE-A-3,620,945 or the corresponding U.S. Pat. No. 4,684,116. The common factor in all of the devices disclosed in these references is that the opening devices are arranged in the transfer region of the printed products to the rests and, due to the opening of the printed products, are themselves actively involved in the depositing operation during the insertion of the rests between the opening printed products. When changing over to printed products of different formats, these known devices require considerable expenditure since all of the components involved in opening and depositing have to be coordinated with one another.

Therefore, a primary object of the present invention is to provide a method and apparatus of the type described above but wherein setting the printed products to be processed to other formats is greatly simplified.

SUMMARY OF THE INVENTION

To achieve this and other objects a method and an apparatus are provided for opening folded printed products and depositing them on saddle-type rests where the opening step and the depositing step are spatially and functionally separated from one another. The printed products are held by individually controllable grippers of a conveying devices at the fold of the printed products. The grippers feed the printed products to an opening device which opens or separates the printed products. The grippers transport the printed products from the opening device to a transfer region which is spaced apart from the opening device. After the printed products have been opened by the opening device, they are held open during the transport to the transfer region by a holding-open mechanism which acts on the two separated parts of the printed products. The printed products are then deposited astride the saddle-type rests in the transfer region.

With such an arrangement, the different functional steps or components, i.e. the opening of the printed products and the depositing on the rests are separated from one another in terms of site and function. When changing over to printed products of different formats, the opening device can thus be set to the new format without taking the rests into consideration, and the new synchronization of the rests with the conveying device can take place without taking the opening device into consideration. Furthermore, the apparatus according to the invention provides better accessibility since the opening device is not located in the transfer region where the rests also take up space.

In a particularly preferred embodiment, the printed products are aligned before they are fed to the opening device. This ensures proper gripping of the printed products by the opening device.

Additional objects, advantages and novel features of the invention will be set forth in part in the description which follows, and in part will become apparent to those skilled in the art upon examination of the following description or may be learned by practice of the invention. The objects and advantages of the invention may be obtained by means of the combinations particularly pointed out in the appended claims.

BRIEF DESCRIPTION OF THE DRAWINGS

The present invention is described in detail with reference to an exemplary embodiment illustrated in the drawings, which is illustrated schematically.

DETAILED DESCRIPTION OF THE PRESENTLY PREFERRED EMBODIMENT

Figure 1:
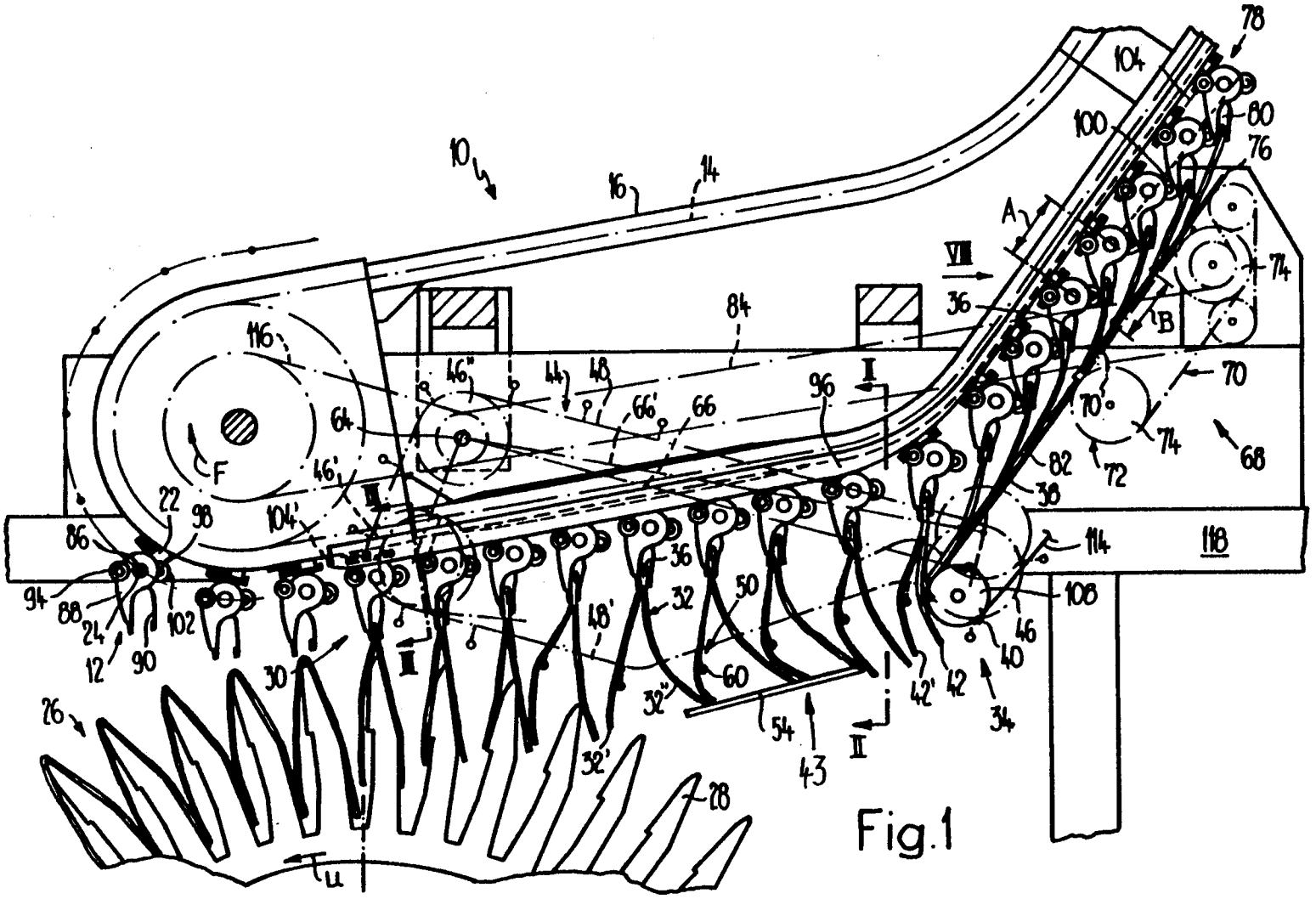
FIG. 1 shows a device for feeding, aligning and opening printed products and depositing them on a saddle-type rest.

Referring now to the figures, FIG. 1 shows part of a conveying device 10 with individually controllable grippers 12 which are arranged at a fixed distance A one after the other on a continuous traction or drawing member 14 (indicated by dot/dashed lines). The traction member 14 is driven in circulation in the conveying direction F. As can also be seen in FIGS. 2, 3, 8 and 9, the traction member 14 comprises a generally known link chain 20 which is guided over wheels 18 in a closed-loop C-shaped rail 16. An extension arm 22 projects at the connection point of each two adjacent links. A gripper 12 is mounted on each extension arm so as to be pivotable about an axle 24 which runs perpendicular to the conveying direction F. Grippers 14 of this type are generally known and are described in detail in Swiss Patent Specification 644,816 and the corresponding U.S. Pat. No. 4,381,056 which are incorporated herein by reference.

A drum-type device 26 for collecting printed products is arranged below the end region of the conveying device 10. Such a drum-type device is described in detail in EP-A-0,341,425 or the corresponding U.S. patent application Serial No. 07/349,303 which are incorporated herein by reference. The collecting device 26 has rests 28 which are arranged in a drum-like manner around a revolving axle (not shown). The longitudinal extent of the rests 28 runs parallel to the revolving axle. The outer ends of the rests (viewed in the radial direction) are spaced apart in the direction of revolution U at approximately the same distance as successive grippers 12 of the conveying device 10 (distance A).

The printed products 32, which have been fed individually by the grippers 12 and previously opened, are deposited on the rests 28 in a transfer region 30. In this transfer region 30, the conveying direction F of the conveying device 10 runs in the same direction as the direction of revolution U of the rests 28 and perpendicular to their revolving axle and longitudinal extent.

An opening device 34 for opening the folded printed products 32 is mounted at a distance upstream of the transfer region 30 (seen in the conveying direction F). Each of the printed products 32 is held by a gripper 12 in the region of its fold 36 which runs perpendicular to the conveying direction F. The printed products 32 are fed with the leading open edge 38 opposite the fold 36 to the opening device 34 which is arranged below the conveying device 10. At the opening device 34, the opening cams 40, circulating in a known manner, grip the half 42 of the printed products 32 lying at the bottom which faces the opening device 34 in the region of the open edge 38 and separate it from the upper half 42'.

Holding-open means 43, together with a holding-open device 44, ensure that the printed products 32, which have been opened by the opening device 34, are held open during further transport to the transfer region 30. Holding-open members 50 are arranged one after the other at a fixed distance (corresponding approximately to the distance A between successive grippers 12) on an endless chain 48. The endless chain 48 is guided around chain wheels 46, 46', 46'', of the holding-open device 44 (see also FIG. 2). In the region of its lower active strand 48', the chain 48 is guided in an approximately S-shape in a guide rail 52. The guide rail 52 runs at the side of the printed products 32 which is being transported by the conveying device 10, as is shown in FIG. 1. In the region of the opening device 34, the chain 48 is guided around the chain wheel 46 such that a holding-open member 50 is inserted in each case from below between the half 42 held by the respective opening cam 40 and the other half 42' of a printed product 32. In the region following the opening device 34 (seen in the conveying direction F) approximately up to the beginning of the transfer region 30, the chain 48 is guided approximately parallel to the rail 16 of the conveying device 10. In this region, the holding-open means 43 also have a guide element 54, for example a guide plate, which runs parallel to the conveying direction F. The opened printed products 32 are drawn over the guide element 54 in a sliding manner by their open edge 38 opposite the fold 36.

With this arrangement, the printed products 32 are lifted such that they are supported in the region of their open edge 38. In this manner, the halves 42 of the printed products 32, which are at the rear in this region, are not affected by the relevant holding members 50. Thus, the halves 42 of the printed products 32 are separated even further from the front halves 42' which are being drawn forwards by the relevant holding-open members 50. From the beginning of the transfer region 30 up to the chain wheel 46', the distance between the lower strand 48' and the conveying device 10 narrows. This results in the distance between the two halves 42, 42' of the printed products 32 decreasing in this region. At the beginning of the transfer region 30, a rest 28 is inserted in each case from below between the front half 42' held by the holding-open member 50 and the trailing rear half 42, still sliding on the guide element 54, of the relevant printed product 32. Thus, during further conveying, the two halves 42, 42' grip around the relevant rest 28 from above as soon as the rear half 42 runs off the guide element 54. Then, the two halves 42, 42' of two successive printed products 32 engage in the collecting device 26 between the relevant rest 28 and the rest 28 adjacent thereto.

Figure 2:
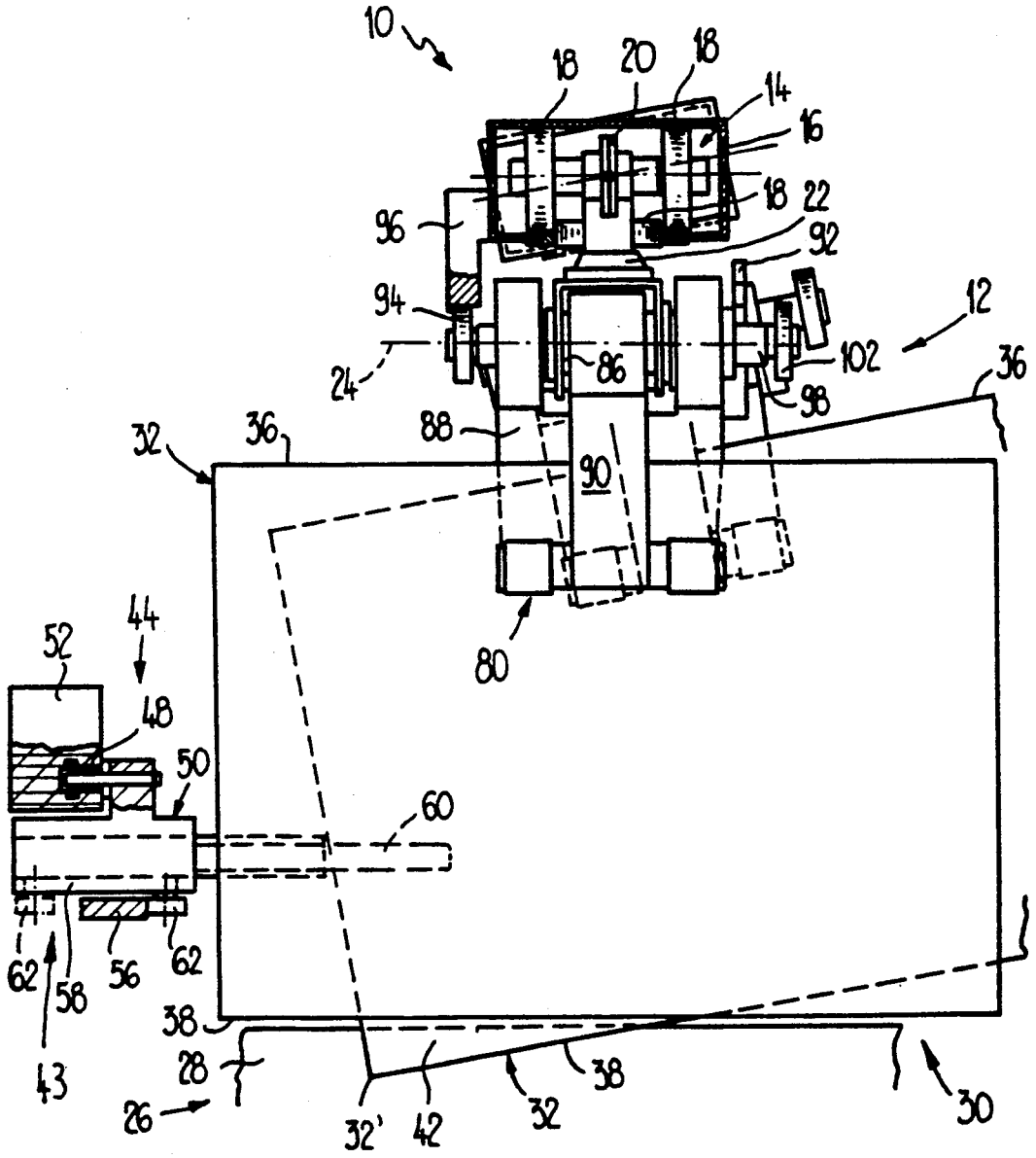
FIGS. 2 and 3 show part of this device in a section along the lines II and III, respectively, of FIG. 1.

The holding-open members 50 have a holding-open pin 60 which can be extended telescopically from a support element 58 by a control cam or link 56, as is best shown in FIG. 2. In the region of the opening device 34, each of holding-open pins 60 is extended so that it is inserted from below between the two halves 42, 42' of the relevant printed products 32. The holding-open pin 60, now engaging from the side between these halves 42, 42', is held by the control cam 56 in its extended position until the printed product 32 grips around the relevant rest 28 from above. Subsequently, the holding-open pin 60 is retracted into the support element 58 under the effect of a restoring spring (not shown in the figures) as is indicated in FIG. 2 by the sliding block 62 drawn in dot/dashed lines. The sliding block 62, which is connected to the holding-open pin 60, interacts with the control cam 56 for extending the holding-open pin 60 and holding it in the extended position. In FIG. 1, the extended holding-open pins 60 are indicated by hatching whereas the retracted holding-open pins 60 are indicated by dashed lines.

The return strand of the chain 48 is guided around the chain wheel 46" which is fixedly seated in terms of rotation on a drive shaft 64. Mounted pivotally on this drive shaft 64 is a bent lever 66 (indicated by dot/-dashed lines). The chain wheel 46' is mounted on one end of the bent lever 66 and chain wheel 46 is mounted on the other end of the bent lever 66. Both the chain wheel 46' and chain wheel 46 are mounted such that they can rotate freely. The opening device 34 is also arranged on the relevant arm of the bent lever 66 in the region of the chain wheel 46. Furthermore, the bent lever 66 rides on the guide rail 52 for the lower strand 48' of the chain 48. Depending on the format of the printed products 32 to be processed in each case, the bent lever 66 can be pivoted continuously from its lower position, (indicated by dot/dashed lines in FIG. 1) into an upper position (denoted by 66') for adaptation to the format.

Of course, the guide element 54 is also adjustable in its distance from the rail 16 in order to adapt its position to the format of the printed products 32 to be processed.

A straightening station 68 is connected upstream of the opening device 34. This straightening station 68 and its interaction with the opening device 34 is described in detail in U.S. patent application Serial No. 07/895,081 entitled "Method And Apparatus For Straightening Printed Products" filed concurrently herewith, which is incorporated herein by reference.

The straightening station 68 is arranged below the conveying device 10 and spaced apart from the opening device 34. As can also be seen, in particular, in FIGS. 8 and 9, it has two mutually parallel and laterally spaced-apart cam circulators 70. The straightening cams 72 are arranged at a mutual distance B which is slightly smaller than the distance A between two successive grippers 12. Each of the active straightening strands 70', which faces the conveying device 10, of the cam circulators 70, is guided around the wheels 74, 74'. The wheels 74, 74' are spaced apart in the conveying direction F with the wheel 74 arranged at the end of the straightening station, viewed in the conveying direction F (see also FIG. 1). As illustrated, the wheels 74, 74' run approximately parallel to the rail 16. The circulators 70 are driven continuously in such a way that, when reaching the wheel 74, straightening cam 72 has a given distance from the relevant gripper 12 which transports that printed product 32 which rests with its leading open edge 38 on the relevant straightening cam 72.

The open edges 38 of the printed products 32 are transported in a suspended position in the region of the straightening station 68. As illustrated, the conveying direction in this region runs obliquely downwards. The open edges 38 of the printed products 32 slide on laterally spaced-apart guide bars 76 and, as soon as the leading edge 38 of a printed product 32 is in the region of the active straightening strand 70', the relevant gripper 12 is partially opened by a control device 78 (schematically illustrated). Thus, the printed product 32 slides under its own weight to rest with its open edge 38 on the mutually corresponding straightening cam 72 of the cam circulators 70 without slipping out of the mouth 80 of the gripper 12. Since the cam circulator 70 is driven slower than the conveying device 10, the relevant printed product 32 is pushed back towards the interior of the mouth 80. The printed product 32 is thus precisely aligned relative to the gripper 12 when its open edge 38 reaches the wheel 74. At this moment, the gripper 12 is again closed by the control device 78 to further transport the printed product 32, shortly before the corresponding straightening cams 72 pivot out of the range of action on the edge 38.

Between the straightening station 68 and the opening device 34, the printed products 32 are guided in the region of their leading open edge 38 by a guide member 82. In this manner, the opening cams 40 of the opening device 34 can grip the half 42 of the printed products 32 lying at the bottom in each case without problems.

The cam circulators 70 are driven by means of a chain drive 84 (indicated by dot/dashed lines) which is likewise coupled to the drive shaft 64. Thus, in order to set the straightening station 68 to the respective format of the printed products 32 to be processed, only the phase position between the cam circulators 70 and the conveying device 10 has to be adapted.

Figure 8:
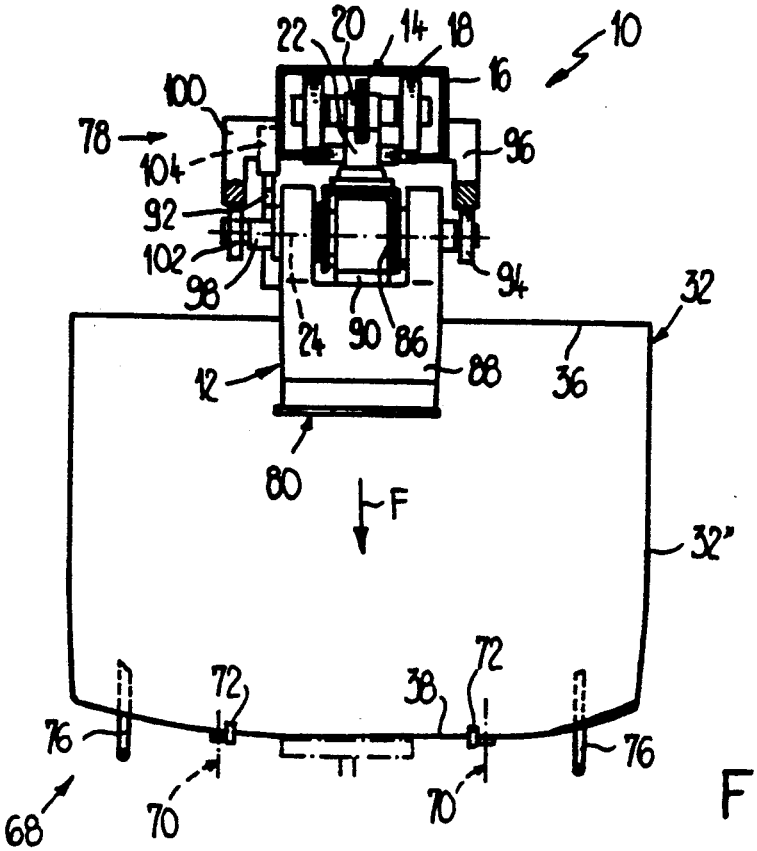
FIGS. 8 and 9 show part of the device in the region of the straightening station during the horizontal and oblique aligning of a printed product respectively, seen in the direction of the arrow VIII of FIG. 1 and partially cut open.
Figure 9:
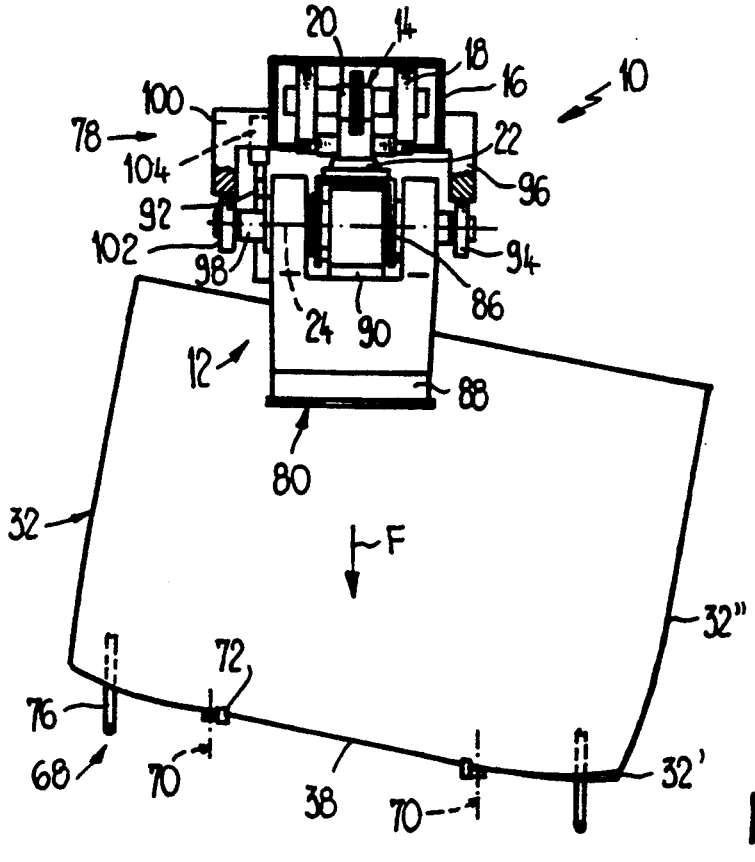

In the straightening station 68 shown in FIG. 8, the mutually corresponding straightening cams of the two cam circulators 70 are aligned in such a way that they lie on a line running perpendicular to the conveying direction F. In this arrangement, the printed products 32 are aligned such that the open edge 38 and thus also the fold 36 run perpendicular to the conveying direction F and parallel to the axle 24 of the grippers 12. If, in contrast, the mutually corresponding straightening cams 72 of the two cam circulators 70 are offset relative to one another (seen in the conveying direction F) the printed products 32 are aligned obliquely relative to the conveying direction F and to the axle 24, as is shown in FIG. 9.

Figure 3:
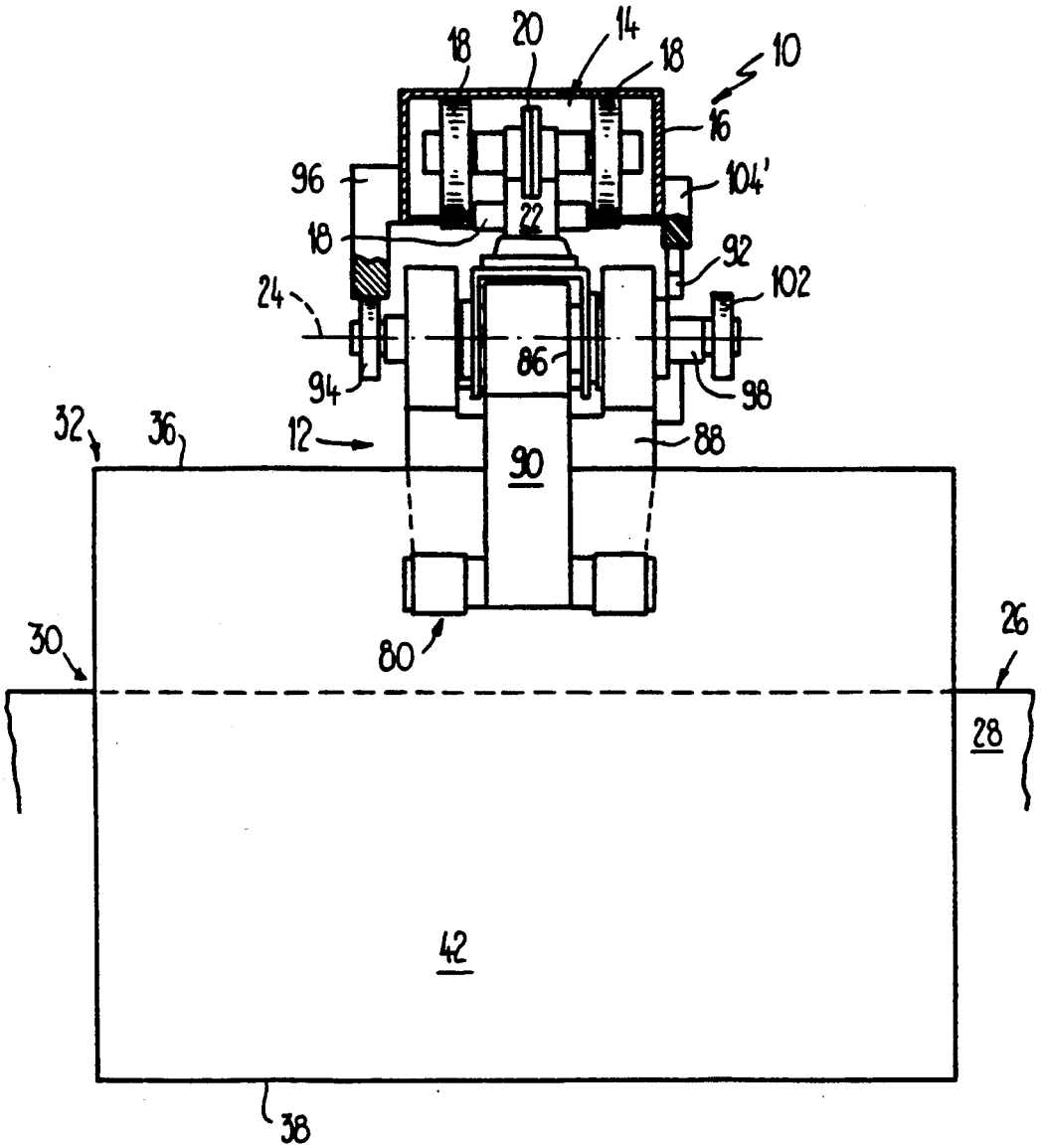

Seen in the conveying direction F, following the opening device 34, the rail 16 is turned about its longitudinal axis as is indicated in FIG. 1 and can be seen best in FIG. 2. Approximately in the center of the transfer region 30, this turning is reversed again, as is shown in FIG. 3. The turning of the rail 16 results in the printed products 32, which are aligned perpendicular to the conveying direction F in the straightening station 68 (FIG. 8), being placed obliquely by pivoting the grippers 12 about an axle which runs in the conveying direction F. This turning also results in the printed products 32 being fed by a downwardly projecting corner 32' to the transfer region. With this corner 32' leading, the printed products 32 are guided onto and grip around the rests 28 (FIG. 2). Due to the reversal of the turning of the rail 16 in the transfer region 30, the printed products 32 are again aligned with their fold 36 parallel to the rests 28. The printed products 32 gradually surround the rest 28 with their entire width starting from the region of the corner 32', as is shown in FIG. 3.

In the transfer region 30, the rests 28 and the grippers 12 also move towards one another so that, at the end of the transfer region 30, the rests 28 have been inserted into the printed products 32 in the vicinity of the region gripped by the gripper 12. At the end of the transfer region 30, the grippers 12 are opened. This opening results in the printed products 32 being dropped onto the rests 28.

As can be seen, in particular, in FIGS. 2, 3, 8 and 9, each gripper 12 has a shaft 86 which runs in the direction of the axle 24 and is mounted rotatably on the extension arm 22. Mounted pivotally about this shaft 86 is the rigidly constructed clamping jaw 88 which is leading in FIG. 1, and a clamping finger 90. The clamping finger 90 is constructed as a leaf spring which interacts with the clamping jaw 88, and is anchored fixedly in terms of rotation on the shaft 86. Arranged pivotally on the clamping jaw 88 is a locking lever 92 which functions to lock the clamping finger 90 relative to the clamping jaw 88 in the clamping position. A position roller 94 is also mounted freely rotatably on the clamping jaw 88. This bearing roller interacts with a position link 96 arranged on the rail 16.

Projecting fixedly in terms of rotation from the shaft 86 is a crossed closing lever 98 with a closing roller 102 rotatably mounted on its end. The closing roller 102 interacts with a closing link or cam 100. The closing cam 100 as well as an opening cam 104, which can be brought into effect on the locking lever 92, are also attached to the rail 16. In the straightening station 68, the closing roller 102 runs up against the closing cam 100 and the opening cam 104 unlocks the locking lever 92. The mutual position of the position link 96 and the closing cam 100 now allows the prestress of the clamping finger 90 to be released and the mouth 80 (formed by the clamping jaw 88 and by the clamping finger 90) to be opened to the extent that the clamping jaw 88 rests lightly with its end on the printed product 32. The printed product 32 can then slide, while slipping in the mouth 80, onto the corresponding straightening cam 72. In order to close the gripper 12, the shaft 86 is pivoted clockwise by the closing cam 100 until the locking lever 92 engages. In this case, the bearing cam 96 prevents the clamping jaw 88 from being able to yield under the pressure of the clamping finger 90.

In order to release the printed products 32 at the end of the transfer region 30, the grippers 12 are now completely opened by means of another opening cam 104'.

Figure 4:
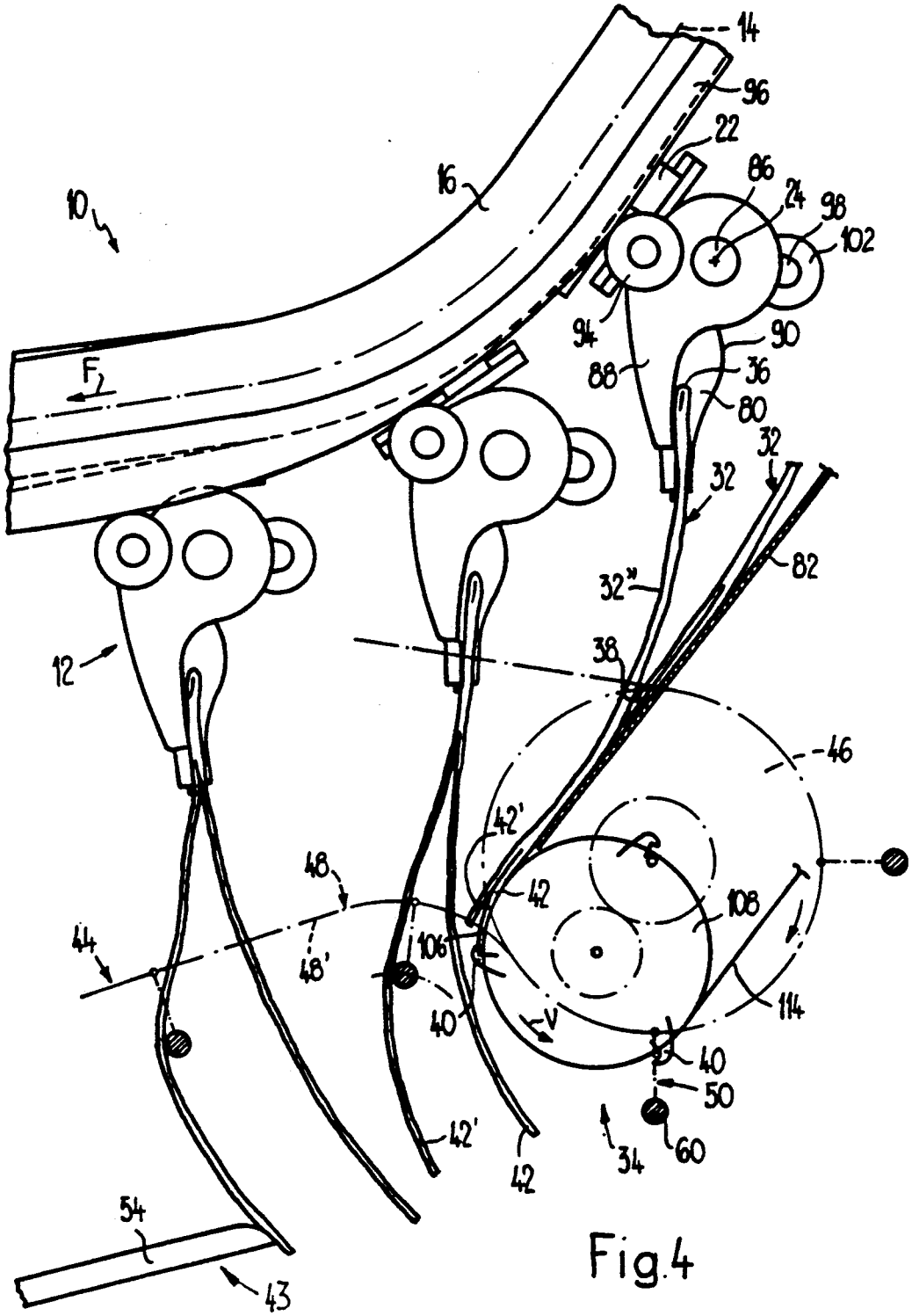
FIGS. 4 and 5 show the region of the opening device at different points in time during the opening of a printed product.
Figure 5:
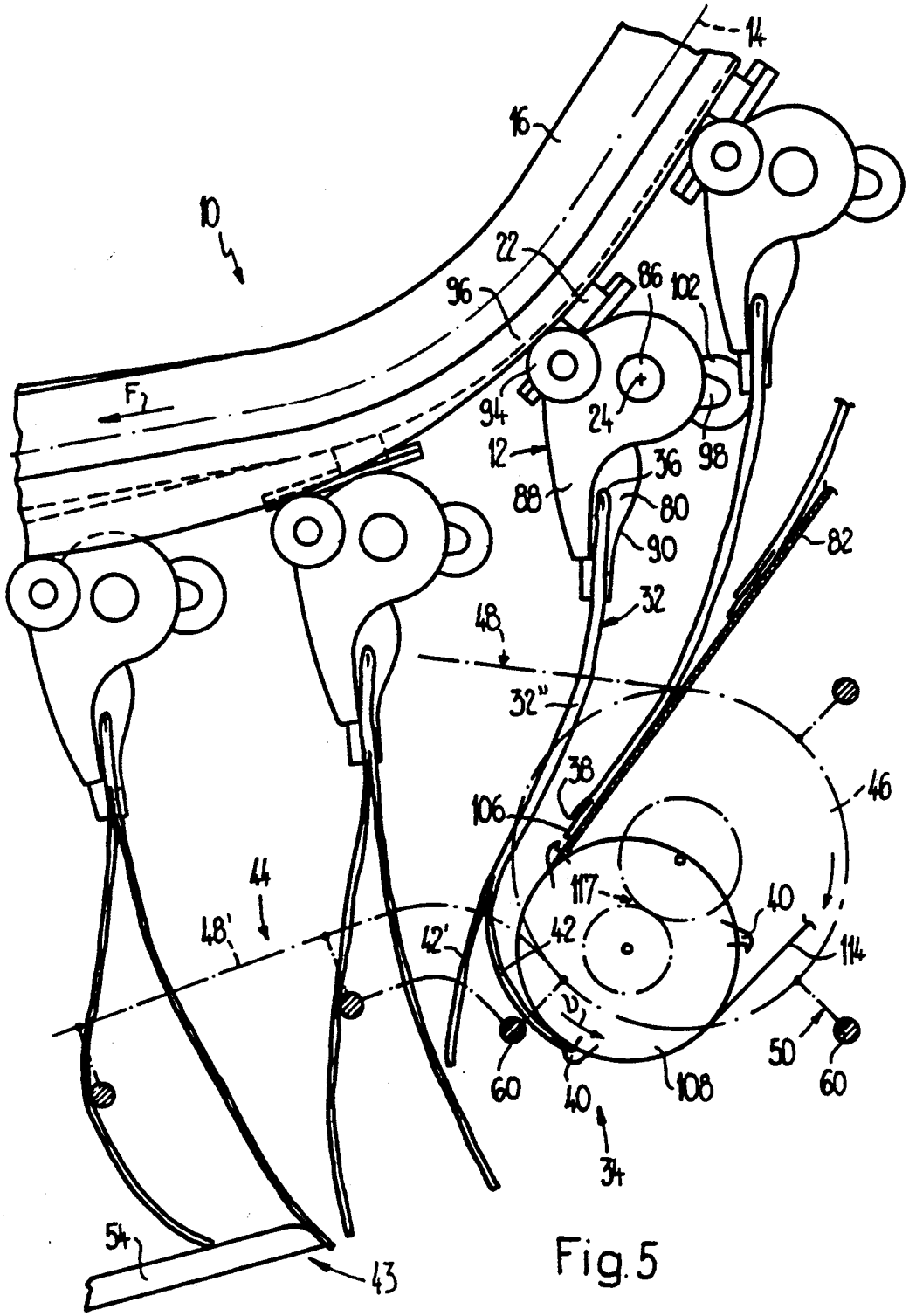

In FIGS. 4 and 5, the interaction of the opening device 34 with the holding-open device 44 is shown at two different points in time during the opening of a printed product 32. The printed products 32 which are held at the fold by the grippers 12 have a so-called prefold 106 in the region of the open edge 38. Thus, the half 42 of the printed product 32 lying at the bottom in the region of the opening device 34 and facing the latter projects over the upper half 42'. The three opening cams 40, arranged along the circumference of the opening roller 108 of the opening device 34, have a shorter mutual distance than the grippers 12 (distance A), and the circumferential speed of the opening roller 108 is correspondingly lower than the conveying speed of the grippers 12. As a result, the prefold 106 is introduced in each case into an opening cam which is directed downwards relative to the direction of revolution V of the opening roller 108 (FIG. 4). The opening cam 40 now holds the lower half 42 of the printed product firmly during further rotation of the opening roller 108 and further movement of the grippers 12. As such, the upper half 42' of the printed product is separated from the lower half 42 from the region of the open edge 38, as is shown in FIG. 5. Since the conveying speed of the grippers 12 is higher than the circulating speed of the opening cams 40, this separation effect is further enhanced.

In this phase of the opening of the printed products 32, an extended holding-open pin 60 is inserted in each case between the halves 42, 42' which are separated from one another in the region of the open edge 38. Relative to the axle of the chain wheel 46, the holding-open pins 60 are offset outwards in relation to the chain 48 (seen in the radial direction). Therefore, the relative speed between the holding-open pin 60 and the opening cams 40 is particularly high, so that little time is required for the insertion. This results in all the more available time for separating the two halves 42 and 42'.

In the region following the chain wheel 46, the chain 48 is guided with a curvature counter to the curvature of the chain wheel 46. The holding-open pins 60 thus travel a shorter path than the chain 48. As such, the holding-open pins 60 catch up to the grippers 12 when they pass through this region, as can be seen particularly clearly in FIGS. 4 and 5. For reasons of completeness, it should also be mentioned that each of the opening cams 40 release the prefold 106 as soon as a holding-open pin 60 has been inserted between the halves 42, 42' separated from one another.

If the printed products 32 are deposited on the rests 28 with one corner 32' leading they only have to be opened in the region of this one corner 32,' as is shown in FIG. 2. In this case, of course, the holding-open device 44 runs along the open side of the printed products 32.

Figure 6:
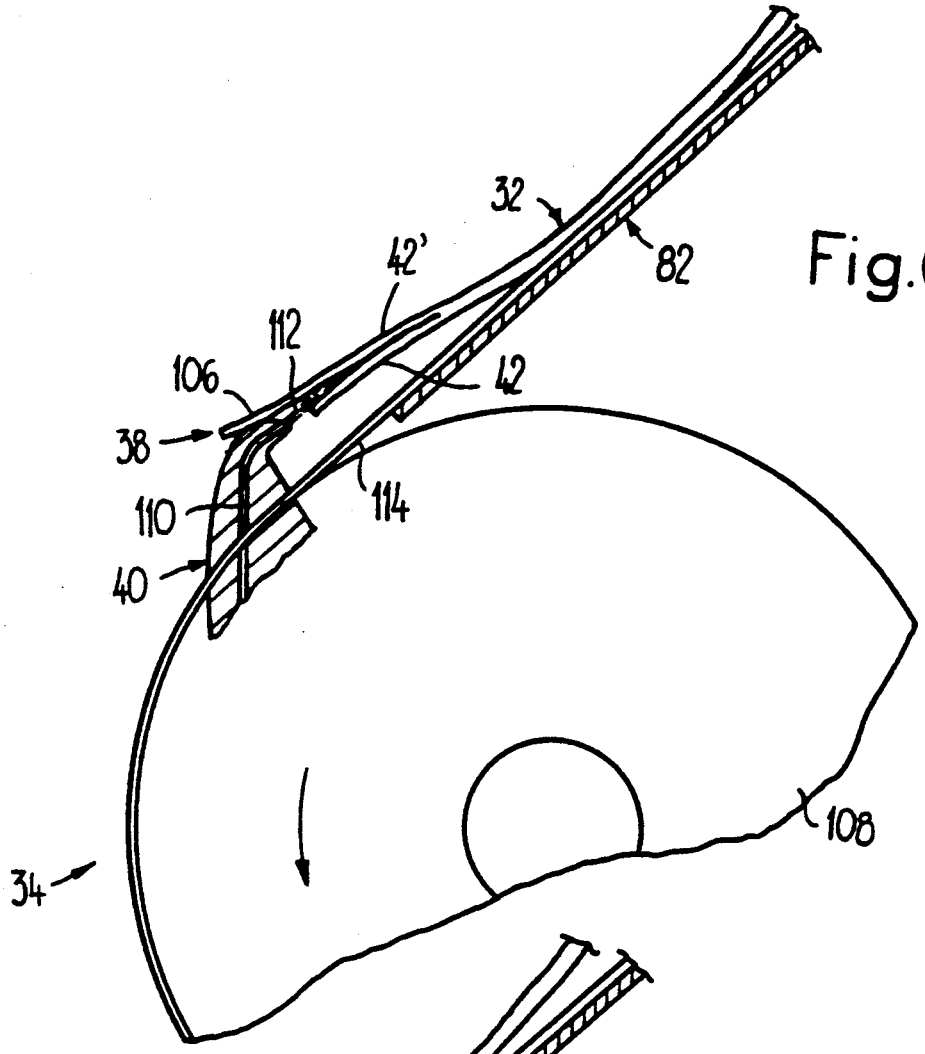
FIGS. 6 and 7 show on an enlarged sectional view of the opening device during the opening of printed products with the prefold lying at the top and at the bottom respectively.
Figure 7:
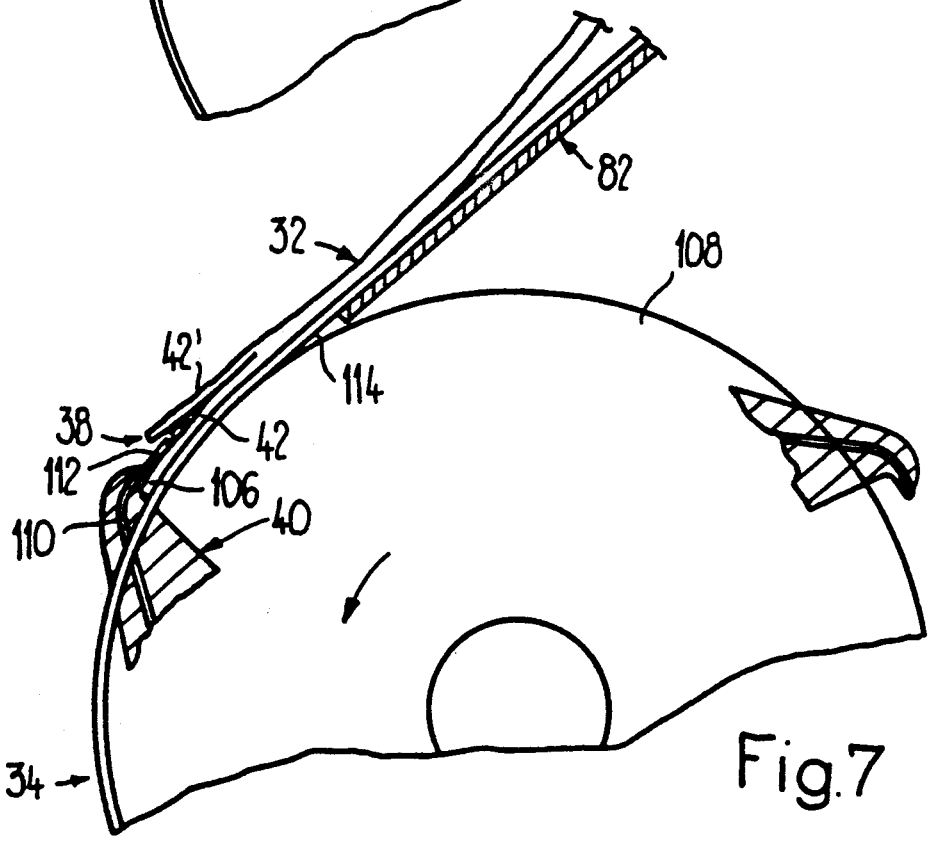

In each of FIGS. 6 and 7, part of the opening roller 108 is illustrated on an enlarged scale. FIG. 6 illustrates a printed product 32 being opened, whose upper half 42' projects over the lower half 42. FIG. 7 illustrates the opening of a printed product 32 with the prefold 106 lying at the bottom. The opening cams 40 are mounted on the opening roller 108 so as to be displaceable in the radial direction. A flow channel 110 runs in the interior of the opening roller 108 in order to blow a jet of air 112 between the two halves 42 and 42' of the relevant printed product 32 at the desired point in time. In order to open printed products 32, in which the upper half 42' projects over the lower half 42 (FIG. 6), the conveying device 10 and the opening device 34 are synchronized with one another such that the relevant opening cam 40 lifts the prefold 106. The lower half 42 is now separated from the upper half 42' by the jet of air 112. By pivoting the opening cam 40, the lower half 42 is inserted with its leading edge under the opening cam 40. By displacing the opening cam 40 inwards in the radial direction, the lower half 42 is then firmly clamped.

If, in contrast, the prefold 106 is lying at the bottom (FIG. 7), the synchronization between the conveying device 10 and the opening device 34 is set such that during pivoting the opening cam 40 overlaps the prefold 106 of the longer lower half 42. The opening cam 40 is now moved inwards in the radial direction in order to clamp the prefold 106 firmly, and a jet of air 112 now facilitates the separation of the upper half 42' of the printed product 32 from the lower half.

In order to ensure proper feeding of the leading open edge 38 of the printed products 32 to the opening device 34, the guide member 82 can house a guide plate and an endlessly circulating strap 114. In this arrangement, the circulating strap 114 is guided via the guide plate and is guided around the opening roller 108 and a deflection wheel (not illustrated) in the region of the straightening station 68, as is best illustrated in FIGS. 6 and 7.

When the printed products 32 are aligned in an oblique position, as is illustrated in FIG. 9, they are opened by means of the opening device 34 in the region of the now leading corner 32'. The opened printed products 32 are held open during further transport to the transfer region 30 by means of the holding-open device 44 in the region of the side edge 32'' adjoining the corner 32'. In this arrangement, turning of the rail 16 is unnecessary in order to feed the printed products 32 to the rests 28 hanging downwards and with the corner 32' leading. In this case, the printed products are completely opened by the insertion of the rests 28 between the halves 42, 42' which are partially separated from one another. By opening the grippers 12, the printed products 32 are allowed to drop onto the rest 28, if appropriate, without placing the fold 36 parallel to said rest.

For reasons of completeness, it should also be mentioned that the traction member 14 is driven via a further chain drive 116 from the drive shaft 64, and the opening roller 108 is operatively connected to the chain wheel 46 via a gear wheel drive 117. The conveying device 10, opening device 34 and straightening station 68 are supported on a schematically indicated frame 118.

Of course, it is also possible to align the printed products during transfer to the grippers 12. In this case, no straightening station 68 is necessary. It is also possible to arrange the rests on a circulator where the longitudinal extent of the rests runs transversely to the direction of circulation of the circulator. In this arrangement, the actively transferring strand of the circulator is preferably straight in the transfer region, and is driven in the conveying direction of the conveying device at a speed approximately corresponding to the conveying speed of the conveying device. When viewed in the conveying direction F, the conveying direction of the conveying device and the direction of movement of the rests run towards one another so that one rest is inserted in each case with its free end region into the open printed products.

A plurality of conveying, opening and holding-open devices 10, 34, 44 and straightening stations 68 are preferably provided in an adjacent arrangement in order to deposit more folded printed products on the rests or on printed products which have already been deposited thereon, the printed products deposited on the rests being displaced in each case in the longitudinal direction of the rests.

The foregoing description of the preferred embodiments of the present invention has been presented for purposes of illustration and description. The preferred embodiments are not intended to be exhaustive or to limit the invention to the precise forms disclosed, and obviously many modifications and variations are possible in light of the above teachings. It is intended that the scope of the invention be defined by the following claims, including all equivalents.

I claim:

1. A method for opening folded printed products and depositing them on a saddle-type rest the method comprising the steps of:

holding the printed products at their fold by means of individually controllable grippers of a conveying device;

moving the controllable grippers in a conveying direction to an opening device;

opening the folded printed products at the opening device;

conveying the opened printed product from the opening device to a transfer region, the transfer region being spaced apart from the opening device;

holding the printed products open with holding-open means separate from the opening device as they are conveyed from the opening device to the transfer region; and depositing each of the open printed products astride a saddle-type rest in the transfer region by opening the grippers.

2. The method of claim 1, wherein the step of conveying the opened printed product from the opening device to a transfer region, comprises:

conveying the printed products with the fold running transversely to the conveying direction; pivoting the grippers about an axle running approximately in the conveying direction such that the printed products are placed obliquely for depositing on the rest, gripping around the rest, with one corner leading in the conveying direction; and pivoting the grippers back again prior to the opening of the grippers.

3. The method of claim 1, wherein the printed products are conveyed with the fold running transversely to the conveying direction and, prior to the opening, aligning the printed products obliquely such that, after opening, the printed products can be deposited on the rest with one corner leading in the conveying direction.

4. The method of claim 1, wherein the step of depositing the open printed products astride a saddle-type rest comprises depositing the printed products on different rests running along with the relevant printed product in the transfer region approximately in the conveying direction wherein the rests are inserted in each case into the opened printed product from the open edge of the printed product.

5. The method of claim 1, wherein:

the printed products are opened on one side to define a leading part and a trailing part; and the step of holding the printed products open with holding-open means comprises holding the printed products open by means of holding-open members which run along and engaging from the side between the two parts of the printed products, and a guide element of the holding-open means which supports the edges, the corresponding holding-open member gripping behind the respective leading part and holding back, by means of the guide element, the trailing part to space apart the leading and trailing parts.

6. The method of claim 1, wherein the printed products are opened beginning from the open edge opposite the fold.

7. The method of claim 1, wherein the printed products are positioned obliquely such that one corner of the printed product comes to rest at the bottom and the printed products are opened beginning from the open edge opposite the fold and from the region of the corner coming to rest at the bottom.

8. The method of claim 1, wherein the printed products are aligned before they pass into the range of action of the opening device.

9. An apparatus for opening folded printed products and depositing them on a saddle-type rest, comprising:

a conveying device having individually controllable grippers which are moved in a conveying direction, and are arranged one after the other, for gripping a printed product at its fold in each case and feeding the printed product to a transfer region, where it can be deposited astride a rest by opening of the gripper;

an opening device for opening the folded printed products prior to depositing to define a leading part and a trailing part of the printed product, wherein the opening device is mounted at a distance upstream of the transfer region;

holding-open means to act on both parts of the printed products which have been separate from one another by means of the opening device for holding the printed products open between the opening device and the transfer region; and the holding-open means being separate from the opening device.

10. The apparatus of claim 9, wherein the conveying direction of the conveying device runs transversely to the longitudinal extent of the rest, and the grippers convey the printed products with the fold running transversely to the conveying direction.

11. The apparatus of claim 9, wherein the holding-open means comprise a holding-open device having holding-open members which are arranged on a traction member, one strand of which runs between the opening device and the transfer region at the side of and approximately in the conveying direction of the conveying device, the holding-open members being introduced between the parts of the printed products, which are separated from one another, at the opening device and the holding-open members being moved approximately along with the printed products, the holding-open members holding the respective leading part apart from the trailing part.

12. The apparatus of claim 11, wherein the holding-open members have holding-open pins which are retracted and extended telescopically transversely to the conveying direction.

13. The apparatus of claim 11, wherein, between the opening device and the transfer region below the conveying device, the holding-open means have a guide element acting in a supporting manner on the lower edges of the hanging printed products in order to hold back the trailing part of each opened printed product relative to the leading part which is drawn in the conveying direction by means of a holding-open device of the holding-open means.

14. The apparatus of claim 9, wherein the printed products are placed obliquely relative to the rest and with one corner hanging down, and the grippers are pivotable about an axle running approximately in the conveying direction in order to feed the printed products to said rest and to align them with the fold parallel to the rest prior to the opening of the grippers.

15. The apparatus of claim 14, comprising a guide member wherein the grippers are guided in the guide member so as to be displaceable in the conveying direction, and the guide member is turned about its longitudinal axis for pivoting the grippers.

16. The apparatus of claim 9, wherein the printed products can move freely in the grippers during at least partial opening of the grippers and comprising a straightening station mounted at a distance, upstream of the opening device for aligning the printed products relative to the grippers during at least partial opening of the grippers.

17. The apparatus of claim 16, wherein the opening device comprises circulating opening cams which grip one part of each printed product in the region of its open edge opposite the fold, and the straightening station aligning the printed products relative to the opening cams.

18. The apparatus of claim 16, wherein the straightening station places the printed products obliquely in order to feed them to the rest with one corner hanging down.

19. The apparatus of claim 16, wherein the straightening station comprises straightening means which is moved approximately in the conveying direction and on which the printed products are brought to rest with one edge, when the grippers are at least partially opened, the grippers being recloseable after the straightening of the printed products by pushing them into the grippers for their further transport.

20. The apparatus of claim 19, wherein the straightening means includes two traction members, which are arranged approximately parallel to one another and are spaced apart perpendicular to the conveying direction, the traction members having straightening cams acting on the open edges of the printed products, the traction members being drivable such that the mutually corresponding straightening cams are arranged on a line running perpendicular to the conveying direction.

21. The apparatus of claim 19, wherein the straightening means includes two traction members, which are arranged approximately parallel to one another and are spaced apart perpendicular to the conveying direction, the traction members having straightening cams acting on the open edges of the printed products, the traction members being drivable such that the mutually corresponding straightening cams are offset relative to one another in the conveying direction for placing the printed products obliquely.

22. The apparatus of claim 9, comprising a plurality of rests which are driven in circulation synchronously with the grippers, are arranged in a drum-like manner, and on which a printed product, fed by a gripper, can be deposited.

23. An apparatus for opening folded printed products and depositing them on a saddle-type rest, comprising:

a conveying device having individually controllable grippers which are moved in a conveying direction, and are arranged one after the other, for gripping a printed product at its fold in each case and feeding the printed product to a transfer region, where it can be deposited astride a rest by opening of the gripper;

an opening device for opening the folded printed products prior to depositing to define a leading part and a trailing part of the printed product, where in the opening device is mounted at a distance upstream of the transfer region;

holding-open means to act on both parts of the printed products which have been separate from one another by means of the opening device for holding the printed products open between the opening device and the transfer region, the holding-open means having an active run comprising a beginning section and an end section, the beginning section being disposed by the opening device and the end section being disposed in the transfer region; and a straightening station mounted at a distance, upstream of the opening device for aligning the printed products relative to the grippers during at least partial opening of the grippers.

* * * * *